US005844356A

United States Patent [19]

Peters et al.

[11] Patent Number: 5,844,356

[45] Date of Patent: Dec. 1, 1998

[54] VACUUM TUBE PROVIDED WITH A LINE-SHAPED GETTER

[75] Inventors: Cornelis Peters; Franciscus M. H. Van Laarhoven, both of Eindhoven, Netherlands

[73] Assignee: U.S. Philips Corporation, New York, N.Y.

[21] Appl. No.: 741,761

[22] Filed: Nov. 5, 1996

[30] Foreign Application Priority Data

Nov. 8, 1995 [EP] European Pat. Off. ..... 95203030

[51] Int. Cl.[6] ..... H01J 19/70

[52] U.S. Cl. ..... 313/481; 313/495; 313/497; 313/422; 313/559

[58] Field of Search ..... 313/497, 496, 313/495, 422, 481, 559, 558, 560, 561

[56] References Cited

U.S. PATENT DOCUMENTS

| | | | |
|---|---|---|---|
| 3,939,376 | 2/1976 | Reash | 313/481 X |
| 5,350,970 | 9/1994 | Vennix et al. | 313/481 |
| 5,541,474 | 7/1996 | LaPeruta et al. | 313/481 |

FOREIGN PATENT DOCUMENTS

| | | |
|---|---|---|
| 0400750 | 12/1990 | European Pat. Off. . |
| 0436997 | 7/1991 | European Pat. Off. . |
| A60-221940 | 11/1985 | Japan . |
| A60-221941 | 11/1985 | Japan . |
| 2295032 | 12/1990 | Japan . |
| A541188 | 2/1993 | Japan . |

*Primary Examiner*—Ashok Patel
*Attorney, Agent, or Firm*—Robert J. Kraus

[57] ABSTRACT

A vacuum tube is provided with a line-shaped getter, which includes a holder (2) with a longitudinal axis, which holder (2) contains a getter material (3) over at least a part of its length, said getter being provided with clamping means to clamp the holder (2). The vacuum tube includes aligning means for exerting a torque about the longitudinal axis of the holder (2), said torque being as small as possible for a preferred orientation of the holder (2) relative to the clamping means. The clamping means preferably includes two leaf springs (7, 7'), which are bent so as to be S-shaped and which are provided with apertures (9, 9', 9") at locations where the leaf springs (7, 7') intersect, for passing the holder (2), and a member (6; 19) is provided on the holder (2) in a clamping manner and the clamping means are provided with an orientation surface (17, 17'; 18, 18'), which extends radially relative to the longitudinal axis of the holder (2). In this manner, during the activation of the getter, displacements of the holder (2) in a direction transverse to the longitudinal axis are precluded. Both constructions can be used independently and cause the position of the holder (2) to be more accurately defined relative to the other elements of the vacuum tube.

11 Claims, 6 Drawing Sheets

VACUUM TUBE PROVIDED WITH A LINE-SHAPED GETTER

BACKGROUND OF THE INVENTION

The invention relates to a vacuum tube having a line-shaped getter comprising a holder with a longitudinal axis, said holder containing a getter material over at least a part of its length, and the getter having clamping means for clamping the holder.

In an evacuated space of a vacuum tube, the vacuum can be improved by providing a so-called getter spot. Said getter spot is provided by arranging a holder in the evacuated space, which holder contains a given quantity of a getter material which is to be evaporated or atomized. Said getter is activated by heating it directly or indirectly during the manufacture of the vacuum tube. After the metal has evaporated from the holder, vapor-deposited metal layers are formed which bind residual gases still present after the evacuation of the vacuum tube. For the getter material use is made, for example, of the metal barium.

Getters are used, for example, in lamps, cathode ray tubes (CRT) and in flat display devices.

A vacuum tube of the type mentioned in the opening paragraph is known from the "Abstract" in the English language of Japanese Patent Application No. 2-295032. In said document, a holder of a line-shaped getter is clamped by means of an arc-shaped resilient element ("member with springiness"). During the activation of the getter, the thermal expansion of the holder is taken up by said resilient element.

In general, (a part of) the getter material present in the holder evaporates during activation of the getter. As a result of thermal expansion caused by the high temperatures (generally above 850° C.) which occur during the (rapid) heating of the holder, evaporation of the getter material may be accompanied by a substantial change in the length of the holder and, in particular if said holder is not heated uniformly, the heating of the holder may give rise to vehement movements of said holder.

A drawback of the known vacuum tube is that, during the activation of the getter, rotation of the holder about its longitudinal axis is not compensated for. Further, during the activation of the getter, displacement of the holder in a direction transverse to the longitudinal axis may occur. As a result of these undesirable effects, a part of the getter material will not evaporate in the proper direction and the getter spot will not be formed at the desired location.

OBJECTS AND SUMMARY OF THE INVENTION

It is an object of the invention to provide a vacuum tube in which the position of the holder relative to other elements of the vacuum tube is more accurately defined. It is a first object of the invention to provide a vacuum tube in which rotation of the holder about the longitudinal axis of the holder during the activation of the getter is compensated for. It is a second object of the invention to provide a vacuum tube in which displacements of the holder in a direction transverse to the longitudinal axis are precluded.

To this end, the vacuum tube in accordance with a first aspect of the invention is characterized in that the vacuum tube comprises aligning means for exerting a torque about the longitudinal axis of the holder, said torque being as small as possible for a preferred orientation of the holder relative to the clamping means.

The invention is based on the recognition that it is important that the orientation of the holder should be and remain well-defined, both during providing the getter in the vacuum tube and during operation. The term "orientation" is to be understood to mean herein a (local) rotation of the holder about its longitudinal axis. The use of aligning means, which exert a torque on the holder, has the advantage that, during the activation of the getter, the location where the getter material is deposited is accurately defined. An additional advantage is that the torque increases as the deviation of the holder relative to the preferred orientation increases, so that the force which is exerted on the holder as a result of said torque increases further, thereby causing the holder to assume the preferred orientation more rapidly. The use of said aligning means causes deviations from the preferred orientation of the holder to be damped as it were by an opposing force which increases as the deviation increases. An opposing force which is a function of the degree of deviation relative to the preferred orientation ensures that, also in the case of vehement movements of the holder during activation of the getter, the holder remains aligned.

In general, the moment is zero if the holder is in the preferred orientation. A first embodiment of the vacuum tube in accordance with a first aspect of the invention is characterized in that the aligning means comprise at least an orientation surface of the holder and of the clamping means, the holder and the clamping means being oriented relative to each other when said holder is clamped.

The advantage of aligning means comprising at least an orientation surface of the holder and of the clamping means is that a simple construction is obtained. The force caused by the torque, which torque develops when the orientation of the holder deviates from the preferred orientation, is exerted, in this preferred embodiment, directly on the holder by the clamping means. The orientation surfaces of the holder and of the clamping means ensure that a specific, preferred orientation of the holder is obtained when the holder is clamped by the clamping means. By virtue thereof, during the activation of the getter, the evaporated getter material is accurately deposited on the desired location (the getter spot) in the vacuum tube.

Preferably, the holder will be embraced in a clamping manner by the clamping means. By virtue thereof, permanent connections, such as welded joints, between holder and clamping means are precluded. During the activation of the getter, temperatures above 850° C. (typical temperature of the holder is 1,000° C.) are attained. If welded joints are used, these joints must at least be resistant to such high temperatures; as a result, the choice of suitable welding materials is limited and the welding operation itself is very cumbersome.

A further embodiment of the vacuum tube in accordance with a first aspect of the invention is characterized in that the aligning means comprise a member on the holder, which member has at least an orientation surface which extends transversely to the longitudinal axis of the holder.

As the member, which embraces the holder, has a larger surface area than the cross-sectional area of the holder, also the orientation surface will be larger, so that in the case of an equally large force on the holder, a larger torque on the surface of the member will be generated as a result of a different orientation of the holder relative to the preferred orientation. The use of said member causes, during the activation of the getter, the evaporated getter material to be deposited very accurately at the desired location, that is the getter spot in the vacuum tube.

Preferably, the member embraces the holder in a clamping manner, so that also in this embodiment permanent connections are precluded. A suitable choice of the clamping properties of the member enables the positioning of said member on the holder to be simplified considerably and corrections in the position of the member on the holder to be made during installation of the getter in the vacuum tube.

An embodiment of the vacuum tube in accordance with a second aspect of the invention is characterized in that the clamping means comprise at least a leaf spring, which is bent so as to be S-shaped, and which is provided with apertures for passing the holder.

An S-shaped spring combines two springs which are arranged in series, and has the advantage that a construction with a good rigidity is obtained, while at the same time great variations in the length of the holder, during the activation of the getter, can be taken up readily. The expression "S-shaped spring" should be interpreted in a broad sense, i.e. it may comprise various (half), bent portions of (leaf) springs; for reasons of symmetry, an even number of (half) arcs will generally be used.

In the known vacuum tube, the holder of the line-shaped getter is clamped by means of a single arc-shaped resilient element, which, on the one hand, must be sufficiently rigid to clamp the holder and which, on the other hand, must exhibit a great mobility of the spring to take up rapid, substantial changes in the length of the holder, which occur when the getter is activated.

A further important advantage of an S-shaped spring is that swiveling of the holder, during the activation of the getter, in the plane of the S-shaped spring is damped. By virtue of the S-shaped construction of the spring, it is further achieved that the change in length takes place in the direction of the longitudinal axis instead of in a direction transverse to said longitudinal axis, if the length of the holder increases as a result of the heating of the getter material. If such an undesirable displacement of the holder is precluded, the getter spot will be deposited very accurately at the desired location in the vacuum tube during the activation of the getter.

In the known vacuum tube, the holder of the line-shaped getter is clamped by means of a single arc-shaped resilient element. A change in the length of a holder which is clamped in such a way causes the tension of the spring to change, as a result of which the spring will become more or less arc-shaped. This further coiling or decoiling of the resilient element causes the point where the resilient element engages the holder to be displaced in the plane of the arc-shaped spring, in other words, the holder moves in a direction transverse to the longitudinal axis of the holder. As a result, the holder no longer has the preferred orientation and the getter spot will not be accurately deposited at the desired location in the vacuum tube.

Preferably, the holder will be embraced in a clamping manner by the clamping means, so that permanent connections between the holder and the clamping means are precluded.

If the aligning means comprise a member on the holder, the S-shaped spring will preferably be provided with at least an aperture for passing the holder, so that the holder can move freely relative to the clamping means, except at the location where the member and the clamping means are in contact with each other.

In addition, the leaf spring and the holder preferably comprise at least an orientation surface, so that, when the holder is clamped, the holder and the clamping means are oriented relative to each other. If the S-shaped leaf spring is provided with apertures at locations where it intersects the longitudinal axis of the holder, the spring can move freely relative to the holder, except at locations where the member and the spring are in contact with each other.

Preferred embodiments of the vacuum tube comprise aligning means in accordance with the first aspect of the invention as well as S-shaped leaf springs in accordance with the second aspect of the invention.

A preferred embodiment of the vacuum tube in accordance with a second aspect of the invention is characterized in that the clamping means comprise two leaf springs, which are bent so as to be S-shaped, and which are provided with apertures, at locations where the leaf springs intersect, for passing the holder, and in that a member is clamped onto the holder and provided with an orientation surface which extends radially with respect to the longitudinal axis of the holder.

In fact, two S-shaped leaf springs form a combination of four (half), bent parts of (leaf) springs, which are arranged in series and two by two, and have the advantage that, in a relatively small space, a construction having a good rigidity is obtained and that large variations in the length of the holder, during the activation of the getter, can be taken up readily. If the holder is provided with a member and if the S-shaped leaf springs are provided with apertures at locations where they intersect the longitudinal axis of the holder, the coupled S-shaped springs can move freely relative to the holder, except at locations where the member and the springs contact each other.

A further important advantage of the combination of two S-shaped springs is that swiveling motions of the holder, during the activation of the getter, in the plane of the S-shaped spring are damped relatively rapidly, while said combination also ensures that, if the length of the holder increases as a result of heating of the getter material, the change in length takes place in the direction of the longitudinal axis instead of in a direction transverse to the longitudinal axis, so that during the activation of the getter an accurately positioned getter spot is obtained.

It will be obvious that the advantage of S-shaped springs also occurs independently of aligning means.

A preferred embodiment of the vacuum tube in accordance with the invention is characterized in that said vacuum tube is provided, on either side of the getter, with aligning means for providing the holder with a preferential orientation.

Providing both sides of the getter with aligning means for preferentially orienting the holder, enables considerable changes in the length of the holder during the activation of the getter to be taken up. If the aligning means comprise S-shaped leaf springs on either side, then even greater changes in length can be taken up. During heating the getter, changes in length of more than 5 mm at a length of the holder of 500 mm are no exception and require, if the getter is clamped by the aligning means, springs having a great flexibility. If, in addition, an accurate positioning of the holder is desired under such conditions, then, during the activation of the getter, rotations about the longitudinal axis of the holder and movements of the holder in a direction transverse to the longitudinal axis should be precluded as much as possible or, at least, be damped effectively as rapidly as possible.

A further embodiment of the vacuum tube in accordance with the invention is characterized in that the holder is clamped in the clamping means so as to be detachable.

A detachable holder with getter material can easily be replaced if a defect occurs during the manufacture of the vacuum tube. It is also possible to replace the holder if it should be necessary to re-open the vacuum tube after it has been evacuated and after the getter has been activated.

These and other aspects of the invention will be apparent from and elucidated with reference to the embodiments described hereinafter.

BRIEF DESCRIPTION OF THE DRAWINGS

In the drawings.

The Figures are purely schematic and not drawn to scale. In particular for clarity, some dimensions are exaggerated strongly. In the Figures, like reference numerals refer to like parts whenever possible.

DESCRIPTION OF THE PREFERRED EMBODIMENTS

Figure 1:
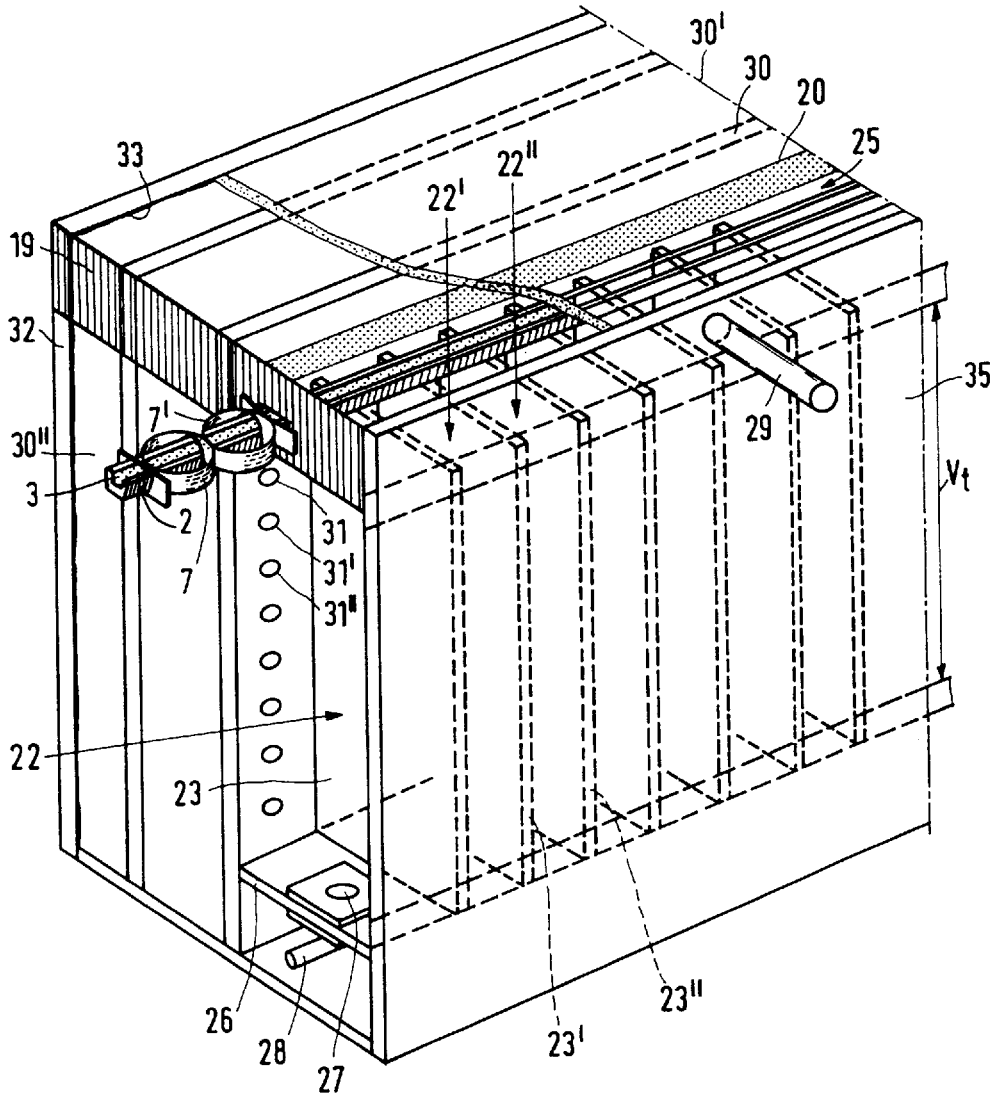
FIG. 1 is a schematic, elevational view, partly broken away, of a part of a flat (color) display device provided with a getter in accordance with the invention.

FIG. 1 is a schematic, elevational view, partly broken away, of a part of a flat-panel (color) display device, in which a number of plates 30, 30', 30", . . . having apertures 31, 31', 31", . . . are provided between a first wall 32 and a second wall 35. On the inner surface of window 32, there is provided a color display screen 33 comprising a pattern of phosphor elements luminescing in red (R), green (G) and blue (B), respectively. The transport ducts 22, 22', 22", which are separated by partitions 23, 23', 23", cooperate with at least a line-shaped electron source 28 via a cathode plate 26 having apertures 27. Such a display device is described in EP-A 0 400 750 and EP-A 0 436 997.

An exhaust connection 29, which is provided, in this example, in the second wall 35 on the rear side of the display device, which is sealed in a vacuum-tight manner in the finished product, ensures that, during the manufacture of the display device, a vacuum pump is in open communication with the transport ducts 22, 22', 22" via the exhaust cavity 25. As the partitions 23, 23', 23" do not extend as far as the end of plate 30 and the second wall 35, a lateral duct system of parallel ducts 22, 22', 22" is formed which are in open communication, at least at one end, with each other and with the exhaust connection 29. Said exhaust connection 29 may alternatively be situated at the top side of cavity 25.

In this example, a getter in accordance with the invention is provided in cavity 25. A holder 2, which contains getter material 3, is provided near an end portion with (two) S-shaped clamping means 7, 7'. If the holder 2 is clamped, the clamping means 7, 7' engage, on the one hand, a member (not shown in FIG. 1) which is clamped onto the holder 2 and, on the other hand, a wall 19 of the display device. At the other end of the getter, the holder 2 may be clamped in a similar manner. A second getter may be provided in the vicinity of the line-shaped electron source 28.

During the activation of the getter, (a part of) the getter material in the holder 2 evaporates, thereby forming a so-called getter spot 20 on a wall of the display device. Dependent upon the orientation of the holder, the getter spot may alternatively be formed, for example, on plate 30 or wall 35. If, during the activation of the getter, the holder 2 moves, either as a result of rotation of the holder 2 about its longitudinal axis, or as a result of displacements of the holder 2 in a direction transverse to the longitudinal axis, a part of the getter material will not evaporate in the proper direction and the getter spot 20 will not be formed at the desired location. A getter spot 20 which is deposited at the wrong location can lead, for example, to a short-circuit in the electric wiring which is necessary to drive the display device.

Figure 2A:
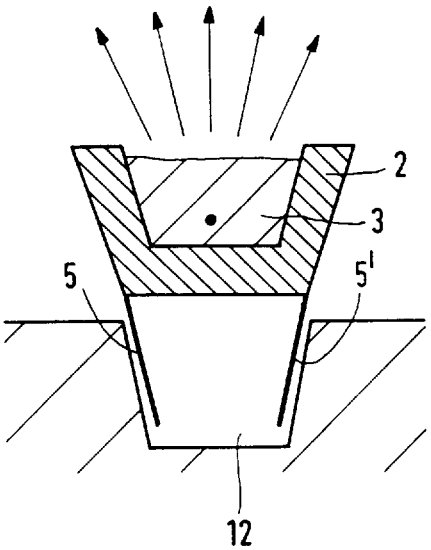
FIG. 2A is a cross-sectional view of an equilibrium condition of a holder provided with two (resilient) aligning means.

FIG. 2A is a schematic, cross-sectional view of an equilibrium condition of a holder 2 which contains a getter material 3 and which is provided with two (resilient) aligning means 5, 5'. In this example, the aligning means 5, 5' are located in a space 12 which is provided with a profile whose shape corresponds to that of the aligning means 5, 5', so that if the holder 2 is in the equilibrium condition, the aligning means do not contact the walls of the space 12. The arrows in FIG. 2A indicate the direction in which the getter material moves, during evaporation or atomization, relative to the holder 2.

Figure 2B:
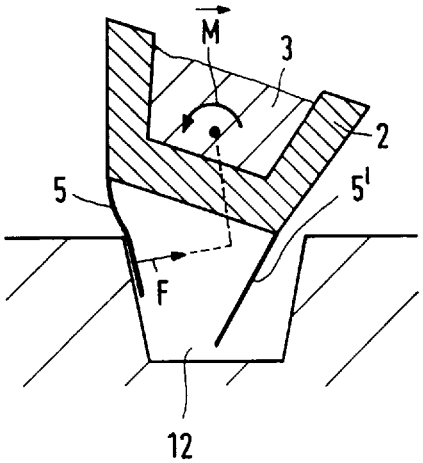
FIG. 2B is a cross-sectional view of a holder which is rotated about its longitudinal axis, a force being exerted on one of the two (resilient) aligning means.

FIG. 2B is a schematic, cross-sectional view of a holder 2 which is rotated about its longitudinal axis, an (opposing) force being exerted on one of the two (resilient) aligning means 5, 5'. As soon as the orientation of the holder 2 deviates from the preferred orientation, one of the aligning means 5, 5' will come into contact with one of the walls of the space 12 (in the example of FIG. 2B, the aligning means 5 resiliently contacts one of the walls of space 12), so that an (elastic) deformation of the aligning means 5 occurs, as a result of which a (normal) force $\vec{F}$ is exerted on the aligning means 5 by the wall of the space 12. Said force $\vec{F}$ brings about a torque $\vec{M}$ about the longitudinal axis of the holder 2, as a result of which the orientation of the holder 2 changes until said orientation corresponds again to the preferred orientation of the holder 2 (see FIG. 2A).

Figure 3A:
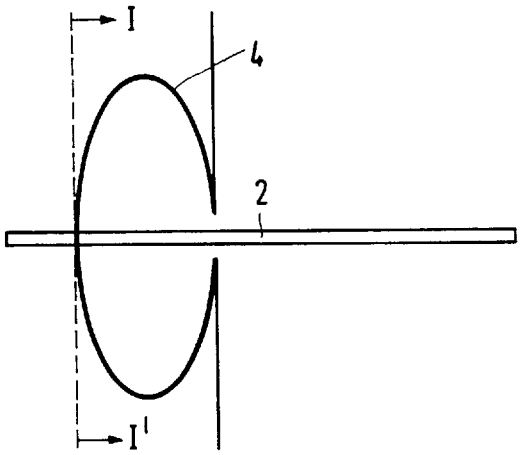
FIG. 3A is a sectional side view of a holder which is clamped by the clamping means.

FIG. 3A schematically shows, in section, a side view of a holder 2 which is clamped by clamping means 4.

Figure 3B:
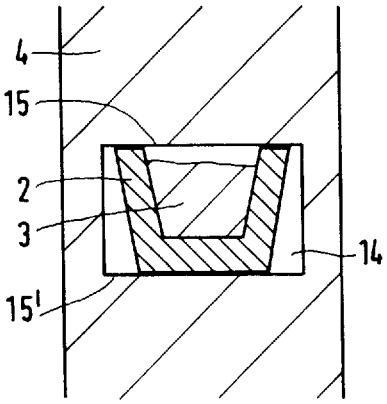
FIG. 3B is a cross-sectional view of the holder, which is rotated through 90° relative to FIG. 3A, which holder is provided through an aperture of the clamping means.

FIG. 3B schematically shows a cross-sectional view, which is rotated through 90° relative to FIG. 3A (along the line I–I'), of the holder 2 which is provided with getter material 3, said holder 2 being provided through an aperture 14 of the clamping means 4. In this example, the holder 2 contacts (in a clamping manner) two walls 15, 15' of the aperture 14 in the clamping means 4, which walls ensure that the holder 2 and the clamping means 4 are oriented relative to each other, and which exert a force on the holder 2 if the orientation of holder 2 deviates from the preferred orientation.

Figure 4A:
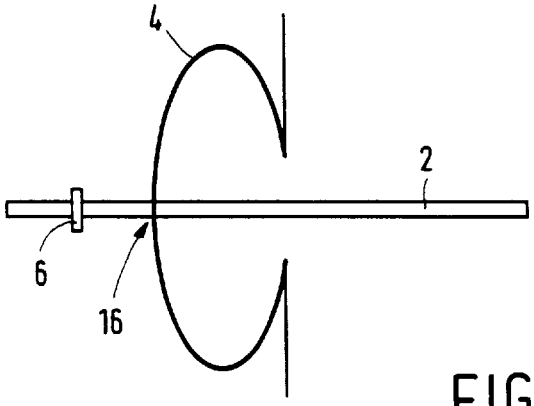
FIGS. 4A, 4B and 4C are sectional side views of a holder provided with a member, and of clamping means provided with an orientation surface.
Figure 4B:
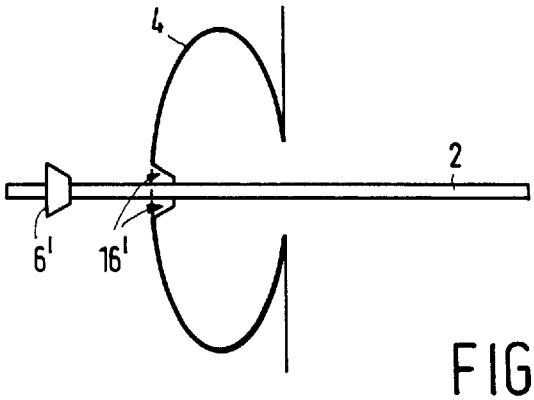
Figure 4C:
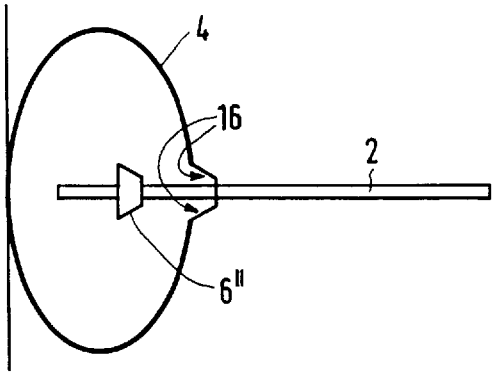

FIGS. 4A, 4B and 4C schematically show, in section, examples of side views of a holder 2 which is provided with a member 6, 6', 6", and of clamping means 4 which are provided with an orientation surface 16, 16', 16", which extends transversely to the longitudinal axis of the holder 2. Unlike the embodiment described in FIGS. 3A and 3B, the aperture in the clamping means 4 at the location of the passage in the holder 2 is such as to enable the holder 2 to move (relatively) freely through said aperture. The member 6, 6', 6" is provided on the holder 2 in a clamping manner. If the member 6, 6', 6" contacts the orientation surfaces 16, 16', 16", an orientation of the holder 2 and the clamping means 4 relative to each other is brought about. As the member 6, 6', 6", which embraces the holder 2, has a larger surface area than the cross-section of the holder 2, also the orientation surface 16, 16', 16" will be larger, so that when a force of equal magnitude is exerted on the holder 2, a larger torque is exerted on the surface of the member 6, 6', 6" as a result of the fact that the orientation of the holder 2 deviates from the preferred orientation.

Figure 5A:
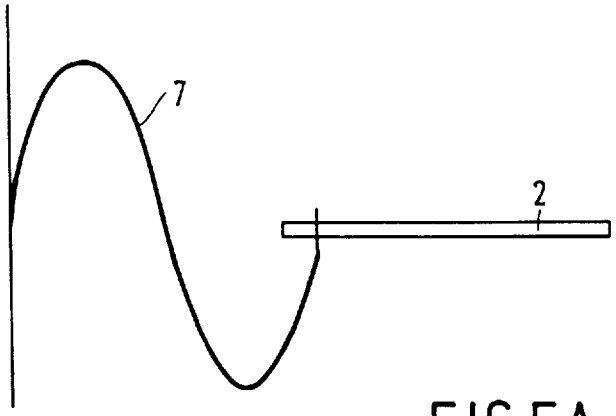
FIG. 5A is a sectional side view of a holder provided with S-shaped clamping means which embrace the holder in a clamping manner.

FIG. 5A is a schematic example, in section, of a side view of a holder 2 which is provided with S-shaped clamping means 7 which embrace the holder 2 in a clamping manner. The clamping contact between the holder 2 and the walls of the aperture in the clamping means 7 is similar to that shown in FIG. 3B.

Figure 5B:
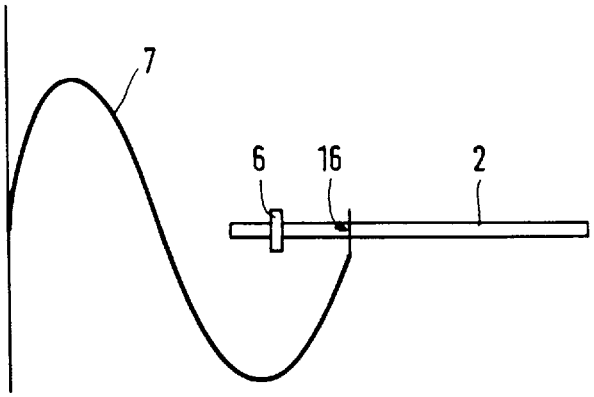
FIGS. 5B and 5C are sectional side views of a holder provided with a member, and of S-shaped clamping means provided with an orientation surface.
Figure 5C:
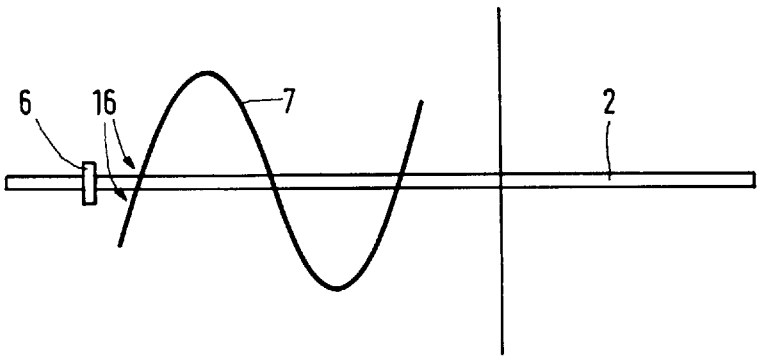

FIGS. 5B and 5C schematically show, in section, side views of a holder 2 which is provided with a member 6 and with S-shaped clamping means 7 which are provided with an orientation surface 16. An aperture in the clamping means 4, at the location of the passage in the holder 2, enables the holder 2 to move (relatively) freely through the aperture. The member 6 is provided on the holder 2 in a clamping manner, so that the holder 2 and the clamping means 7 are oriented relative to each other when the member 6 (resiliently) contacts the orientation surface 16.

Figure 6A:
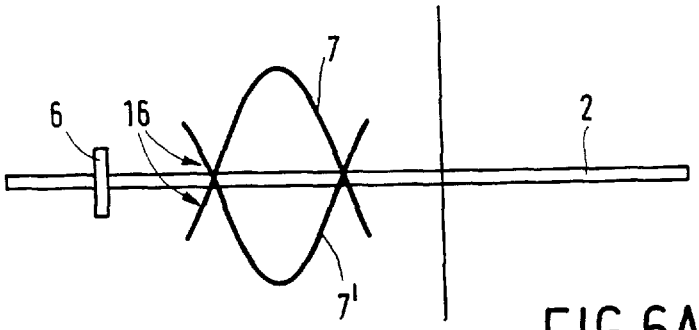
FIG. 6A is a sectional side view of a holder provided with a member, and of two S-shaped clamping means provided with an orientation surface.

FIG. 6A schematically shows, in section, a side view of a holder 2 which is provided with a member 6 and with two (half) S-shaped clamping means 7, 7' which are provided with orientation surfaces 16. The member 6 is provided on the holder 2 in a clamping manner, while the clamping means 7, 7' are provided with apertures at the locations where they intersect the longitudinal axis of the holder 2. The two arcs 7, 7', which engage each other so as to be symmetrical, have the advantage that an effective spring is obtained which is useful, in particular, if the space for clamping a holder 2 in the vacuum tube is limited.

Figure 6B:
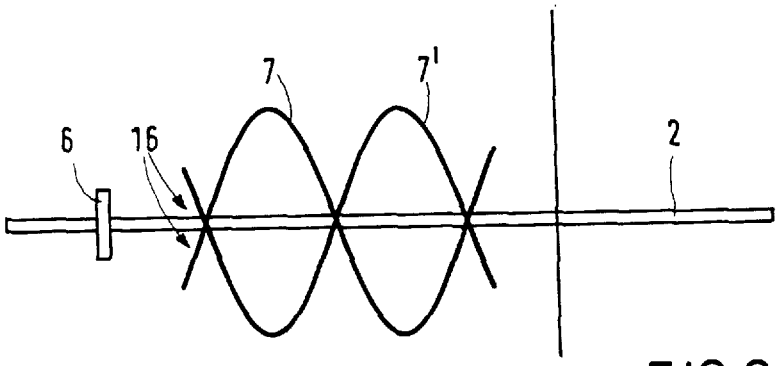
FIG. 6B is a sectional side view of a holder provided with a member, and of two S-shaped clamping means provided with an orientation surface.

FIG. 6B schematically shows, in section, a side view of a holder 2, which is provided with a member 6 and with two S-shaped clamping means 7, 7', which are provided with orientation surfaces 16. The member 6 is provided on the holder 2 in a clamping manner, while the clamping means 7, 7' are provided with apertures at locations where they intersect the longitudinal axis of the holder 2.

Figure 6C:
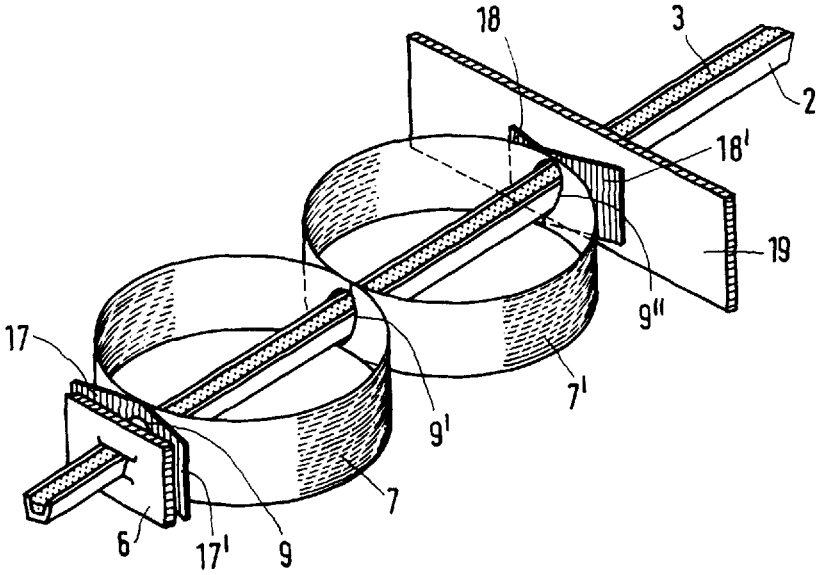
FIG. 6C is a perspective elevational view of the holder shown in FIG. 6A.

FIG. 6C is a schematic, elevational view of the holder 2 shown in FIG. 6B. Two S-shaped clamping means 7, 7' are provided, at locations where they intersect the longitudinal axis of the holder 2, with, preferably elliptical, apertures 9, 9', 9", so that the holder 2, which is provided with a getter material 3, can move (relatively) freely relative to the clamping means 7, 7'. The member 6 is provided on the holder 2 in a clamping manner.

To this end, the member 6 shown in the example of FIG. 6C is provided (in the center) with H-shaped cuts and with a recess for the holder 2. By matching the width of the recess with the width of the holder 2 and by making the height of the recess smaller than the height of the holder 2, it is achieved that, if the member 6 is slid over the holder 2, the upper side and the lower side of the H-shaped cuts extend obliquely relative to the direction of sliding, thereby preventing the member 6 from sliding back. An advantage of this construction of the member 6 is that during mounting the holder 2 in the vacuum tube, corrections in the position of the member 6 on the holder 2 can be carried out.

During clamping of the holder 2, on the one hand, the orientation surfaces 17, 17' of the two arc-shaped (leaf) springs 7 engage the member 6 and, on the other hand, the orientation surfaces 18, 18' of the two arc-shaped leaf springs 7' engage a wall 19 of the vacuum tube. The orienting effect of the member 6 relative to the orientation surfaces 17 and 17', and the orienting effect of the wall 19 of the vacuum tube and the orientation surfaces 18, 18' ensure that the holder 2, after the getter has been clamped, is in the preferred orientation and stays in said preferred orientation also during activation of the getter, and that in the case of vehement movements of the holder 2 during the activation of the getter, the holder 2 remains oriented or, at least, that these movements are damped effectively.

Figure 7:
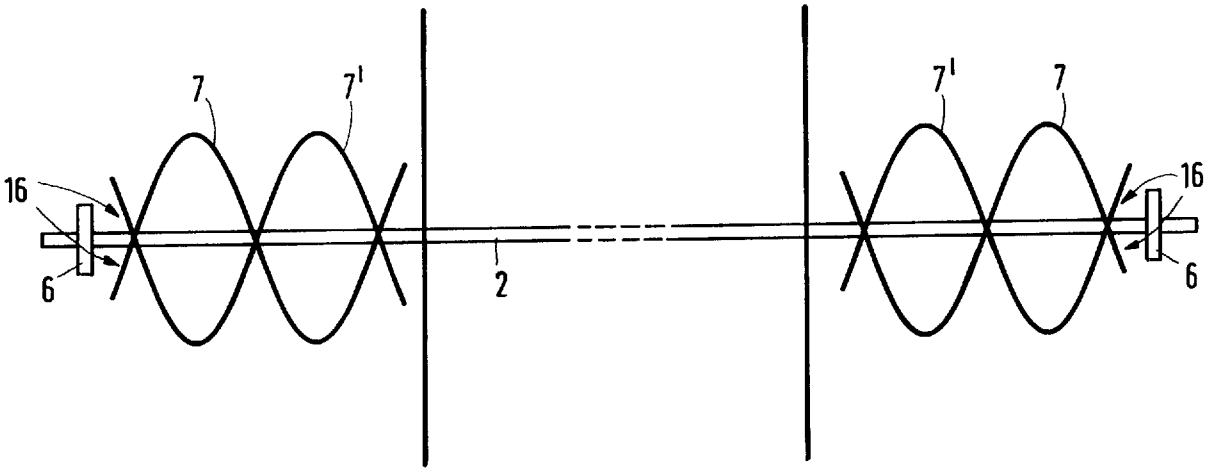
FIG. 7 is a sectional side view of a holder provided, on both sides, with a member, and of two S-shaped clamping means provided with an orientation surface.

FIG. 7 schematically shows, in section, a side view of a holder 2 which is provided on both sides with a member 6 and with two S-shaped clamping means 7, 7', which are provided with an orientation surface. By providing such a construction on either side of the holder 2, (relatively) long wire getters can be used.

Line-shaped getters, as described in this invention, are successfully used, for example, in flat-panel display devices. In display devices having larger dimensions (for example with a picture diameter of the order of 50–150 cm), changes in the length, during heating of the getter, of more than 5 mm at a length of the holder 2 of 500 mm are no exception. Line-shaped getters in such display devices must meet high requirements: on the one hand, the springs must have a high rigidity to clamp the getter and to keep it in said condition, on the other hand, the springs must have a high flexibility to take up substantial changes in length. If, in addition, an accurate positioning of the holder 2 is desired under such conditions, then, during the activation of the getter, rotations about the longitudinal axis of the holder 2 and movements of the holder 2 in a direction transverse to the longitudinal axis must be precluded as much as possible or, at least, be damped effectively.

It will be obvious that within the scope of the invention many variations are possible to those skilled in the art.

In general, the invention relates to a vacuum tube, which is provided with a line-shaped getter comprising a holder with a longitudinal axis, said holder containing a getter material over at least a part of its length, and said getter being provided with means for clamping the holder. The vacuum tube comprises aligning means for exerting a torque about the longitudinal axis of the holder, said torque being as small as possible for a preferred orientation of the holder relative to the clamping means. The clamping means preferably comprise two leaf springs, which are bent so as to be S-shaped, and which are provided with apertures, at locations where the leaf springs intersect, for passing the holder, and a member is provided on the holder in a clamping manner and provided with an orientation surface which extends radially relative to the longitudinal axis of the holder. In this manner, during the activation of the getter, displacements of the holder in a direction transverse to the longitudinal axis are precluded. Both constructions can be used independently and ensure that the position of the holder relative to other elements of the vacuum tube is accurately defined.

We claim:

1. A vacuum tube having a line-shaped getter comprising a holder with a longitudinal axis, said holder containing a getter material over at least a part of its length, and the getter having clamping means for clamping the holder, characterized in that the vacuum tube comprises aligning means on either side of the getter for providing the holder with a preferential orientation, said aligning means on at least one side of the getter exerting a torque about the longitudinal axis of the holder, said torque being as small as possible for a preferred orientation of the holder relative to the clamping means.

2. A vacuum tube as claimed in claim 1, characterized in that the aligning means comprise at least an orientation surface of the holder and of the clamping means, the holder and the clamping means being oriented relative to each other when said holder (2) is clamped.

3. A vacuum tube as claimed in claim 2, characterized in that the aligning means comprise a member on the holder, which member has at least an orientation surface which extends transversely to the longitudinal axis of the holder.

4. A vacuum tube as claimed in claim 1, characterized in that the aligning means comprise a member on the holder, which member has at least an orientation surface which extends transversely to the longitudinal axis of the holder.

5. A vacuum tube as claimed in claim 1, characterized in that the holder is clamped in the clamping means so as to be detachable.

6. A vacuum tube having a line-shaped getter comprising a holder with a longitudinal axis, said holder containing a getter material over at least a part of its length, and the getter having clamping means for clamping the holder, characterized in that the vacuum tube comprises aligning means for exerting a torque about the longitudinal axis of the holder, said torque being as small as possible for a preferred orientation of the holder relative to the clamping means, characterized in that the aligning means comprise at least an orientation surface of the holder and of the clamping means, the holder and the clamping means being oriented relative to each other when said holder is clamped and characterized in that the clamping means comprise at least a leaf spring, which is bent so as to be S-shaped, and which is provided with apertures for passing the holder.

7. A vacuum tube as claimed in claim 6, characterized in that the clamping means comprise two leaf springs which are bent so as to be S-shaped, and which are provided with apertures, at locations where the leaf springs intersect, for passing the holder, and in that the member is clamped onto the holder and provided with an orientation surface which extends radially with respect to the longitudinal axis of the holder.

8. A vacuum tube having a line-shaped getter comprising a holder with a longitudinal axis, said holder containing a getter material over at least a part of its length, and the getter having clamping means for clamping the holder, characterized in that the clamping means comprise at least a leaf spring which is bent so as to be S-shaped, and which is provided with apertures for passing the holder.

9. A vacuum tube as claimed in claim 6, characterized in that the clamping means comprise two leaf springs, which are bent so as to be S-shaped, and which are provided with apertures at locations where the leaf springs intersect, for passing the holder and in that a member is clamped onto the holder and provided with an orientation surface, which extends radially relative to the longitudinal axis of the holder.

10. A vacuum tube having a line-shaped getter comprising a holder with a longitudinal axis, said holder containing a getter material over at least a part of its length, and the getter having clamping means for clamping the holder, characterized in that the vacuum tube comprises aligning means for exerting a torque about the longitudinal axis of the holder, said torque being as small as possible for a preferred orientation of the holder relative to the clamping means, characterized in that the aligning means comprise a member on the holder, which member has at least an orientation surface which extends transversely to the longitudinal axis of the holder and characterized in that the clamping means comprise at least a leaf spring, which is bent so as to be S-shaped, and which is provided with apertures for passing the holder.

11. A vacuum tube having a line-shaped getter comprising a holder with a longitudinal axis, said holder containing a getter material over at least a part of its length, and the getter having clamping means for clamping the holder, characterized in that the vacuum tube comprises aligning means for exerting a torque about the longitudinal axis of the holder, said torque being as small as possible for a preferred orientation of the holder relative to the clamping means, characterized in that the clamping means comprise at least a leaf spring, which is bent so as to be S-shaped, and which is provided with apertures for passing the holder.

* * * * *